United States Patent [19]

Marcell

[11] 3,974,980

[45] Aug. 17, 1976

[54] WIRE DISPENSING DEVICE

[75] Inventor: William B. Marcell, Fort Lauderdale, Fla.

[73] Assignee: Jet Line Products, Inc., Matthews, N.C.

[22] Filed: Dec. 30, 1974

[21] Appl. No.: 537,554

[52] U.S. Cl. ..... 242/128; 242/129

[51] Int. Cl.[2] ..... B65H 49/00

[58] Field of Search ..... 242/128, 129, 77.2; 206/389, 409; 248/318, 323, 324

[56] References Cited

UNITED STATES PATENTS

| | | | |
|---|---|---|---|
| 2,961,185 | 11/1960 | Seigle | 242/130 |
| 3,729,092 | 4/1973 | Marcell | 242/129 X |
| 3,778,000 | 12/1973 | Breuner et al. | 242/77.2 |

FOREIGN PATENTS OR APPLICATIONS

| | | | |
|---|---|---|---|
| 151,858 | 12/1937 | Austria | 403/96 |

*Primary Examiner*—Leonard D. Christian
*Attorney, Agent, or Firm*—Johnson, Dienner, Emrich & Wagner

[57] ABSTRACT

A wire reel for dispensing wire from coils or cartons including rotatable means for paying out the wire without twists or kinking, means to retard the rotation of the reel when wire is being withdrawn therethrough, means for quick disconnect of the suspending lines for the base plate from the plate and means for secure assembly of the disconnect means from the suspending means.

8 Claims, 13 Drawing Figures

WIRE DISPENSING DEVICE

This invention is directed to a wire reel and comprises improvements on my U.S. Pat. No. 3,729,092, issued Apr. 24, 1973, for unwind support for coiled wire.

Use of the patented device in the field has indicated that there was room for improvement in several aspects: one of the difficulties was that no provision was made for braking or retarding the rotation of the device as the wire was uncoiled therefrom. In my improved device, I have provided an adequate brake feature so that as the wire is unwound, the coil will not spin to feed out more length of wire than the user requires. A second consideration was the need for the provision of a rotating fairlead or wire guide through which the wire could be fed in a rapid and effective manner.

In my patented device, I provided means for transporting wire from site to site. Where the coil was bulky, this required quick disconnection of the suspending lines which carry the wire while it was being unwound where the wire to be transported was bulky. In this respect, I have devised a quick disconnect feature which facilitates conversion of the reel from the operating position to the transporting position. Since I have found the use or rubber tubing the most efficacious material for the suspending lines, I have devised a means for securely fixing the bayonet of the quick disconnect to the carrying lines at the same time permitting the bayonet to be moved into a position for its connection to or disconnection from the base plate of the device while it is in use.

These and other features of the invention are more particularly pointed out in the following specification and the appended claims.

Figure 1:
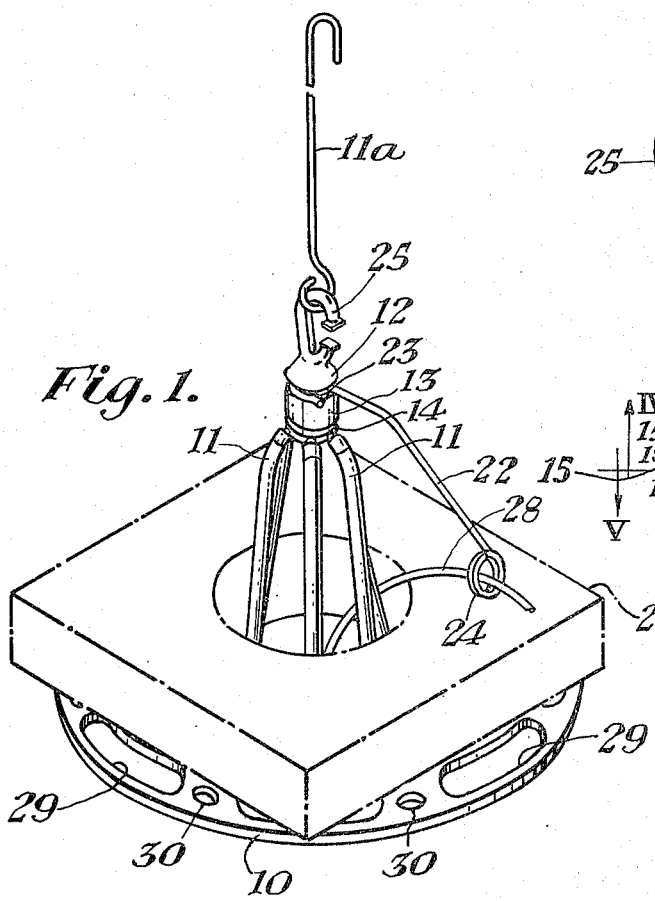
FIG. 1 is a perspective view of the device assembled for use and suspended from a suitable object, with a box of coiled wire located on the plate with wire from the coil being threaded through the pigtail of the fairlead ready for application by an electrician, for example.
Figure 10:
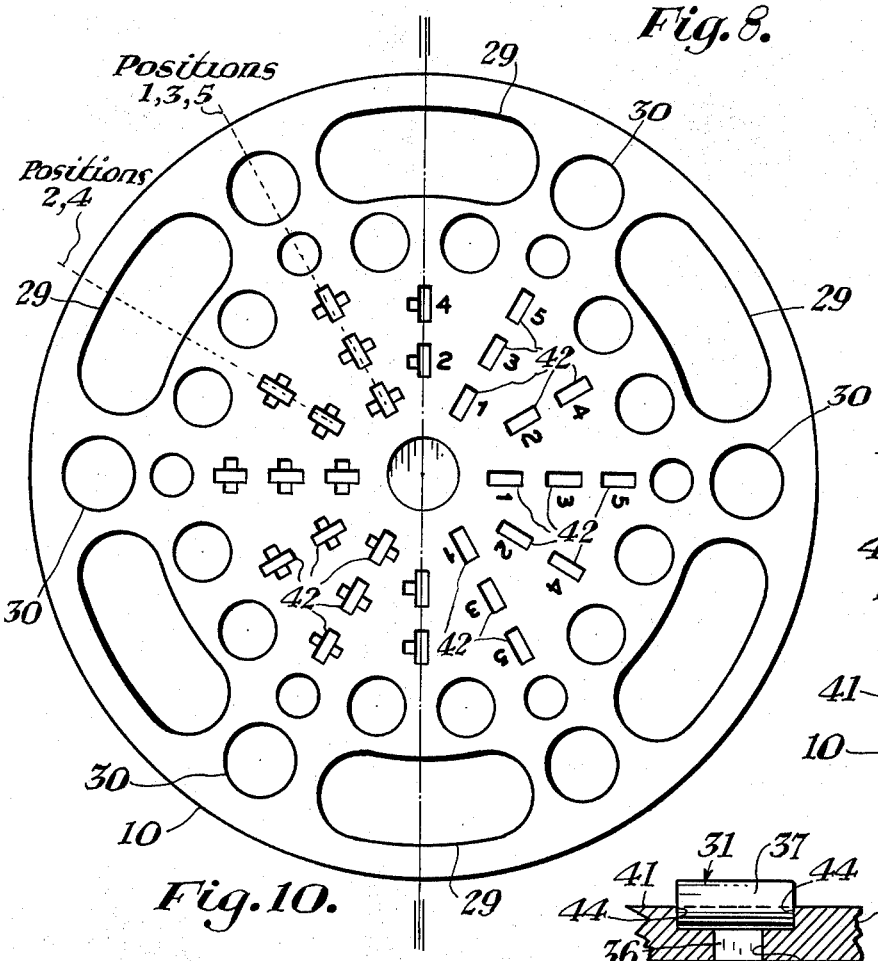
FIG. 10 is a plan view, the right side thereof being the obverse of the plate, the left side thereof being the reverse thereof.

Referring now to FIG. 1 specifically, where the device is shown in operational position for the dispensing of wire, it includes a plate 10, having six carrying openings 29 spaced therearound and six hook openings 30, located between each of the carrying openings shown more particularly in FIG. 10. The plate is further provided with a series of bayonet openings 42 spaced in five positions in pairs of positions 2 and 4 and triplets of positions 1, 3 and 5, shown more specifically in FIG. 10. The reason for the spacing of the openings is to accommodate the varying sizes of inner diameters of coils of wire, or cartons 27 of wire, in the event that cartons are utilized by the operator. Where the inner diameter of the coil is small, positon 1 is used. As the wire is paid out from the interior of the coil and the interior diameter becomes larger, the flexible suspending lines can be moved from a short to a longer radius as the occasion may require.

Figure 3:
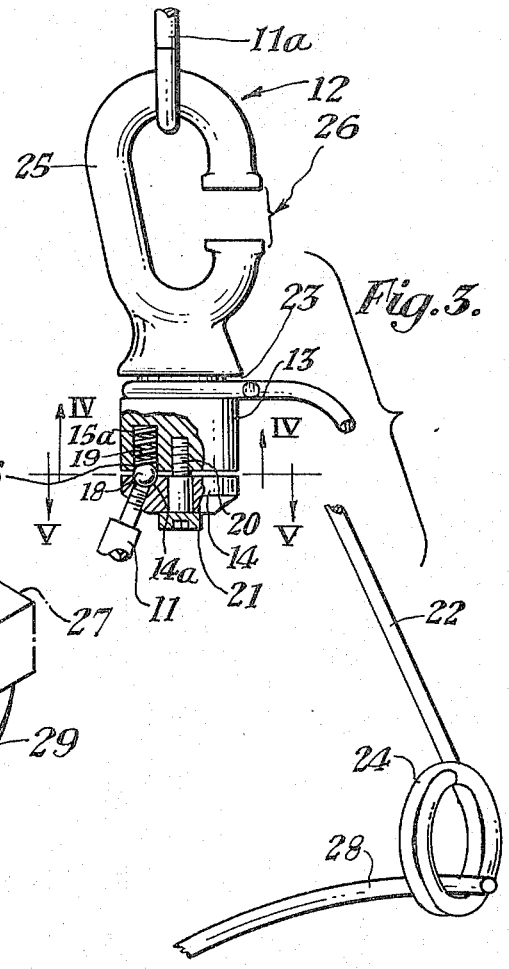
FIG. 3 is a side elevational view of the hanging means, including the hook, showing one suspending line in position, broken away, with the pigtail on the fairlead disposed to the right and wire, broken away, threaded therethrough and partly broken away to show the interior construction.
Figure 2:
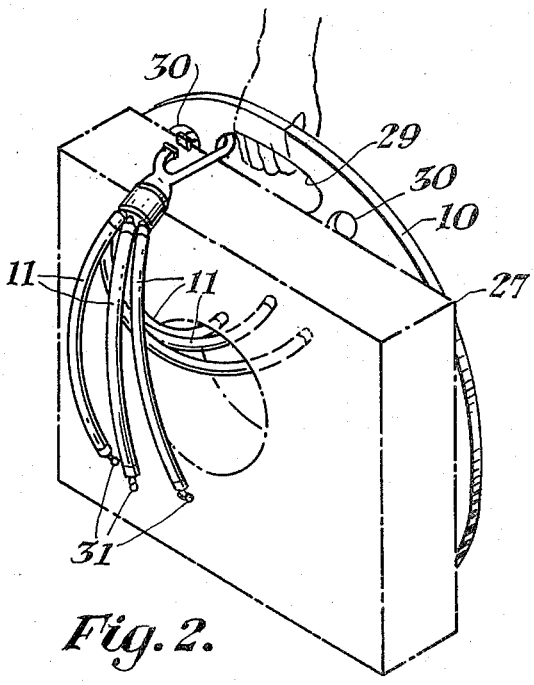
FIG. 2 is a side view, in perspective, of the device ready for carriage by the artisan.

In my commercial product, I utilize six flexible suspending lines 11, FIGS. 1, 2 and 3, the proximal ends of which are connected as shown to the rotatable disc 14 on the rotatable hanging means 12. The distal ends of the flexible suspending lines 11 are inserted by the bayonet 31 into the bayonet openings 42 at locations, as previously described, depending upon the diameter of the coil of wire to be dispensed. The manner of connecting and disconnecting the bayonets will be hereinafter described.

Referring still to FIG. 1, the wire 28 is lead from the carton 27 through the wire guide 22, through the pigtail 24 where it may be drawn by the operator to any desired location. As the wire is drawn, the device rotates on the rotatable hanging means 12 connected to a hanger 11*a*, suspended, say, from a rafter, and the wire guide 22 maintains its position in the direction of draw by riding on the circular channel 23 in the base 13 of the rotatable hanging means 12, see FIG. 3. At the top of the rotatable hanging means 12, a hook 25 is provided which can be hooked to a hanger 11*a* hooked over any convenient location for suspension such as a rafter, for example.

Referring now to FIG. 2, when withdrawal of the wire 28 at a location has been completed and the device requires transportation to another location, the hook and hanger can be disconnected from the object to which it was connected and reconnected to one of the hook openings 30 in the plate. In the event that the wire 28 to be transported is bulky, one or more of the flexible suspending lines may be disconnected from the plate 10, as shown in FIG. 2, so that undue strain is not placed on the flexible suspending lines 11. Then, the operator can transport the device to a new location, disconnect the hook 25 from the plate 10, relocate such flexible suspending lines 11 as have been disconnected and suspend the device by the hook 25 at the new location for further dispension of wire.

Referring now to FIGS. 6–9, they show the configuration of the distal ends of the suspending lines with the bayonet fixture 31. The suspending lines are made preferably of a rubber tubing, the relaxed inner diameter of which is less than the diameter of the mandrel 32 which, in assembly, is inserted into the tubing to its full length. A similar mandrel, not shown, is inserted in the proximal end of the tubing. This mandrel has a threaded end which is inserted into one of the internally threaded openings of the frustro-conical rotatable disc 14 (FIG. 3).

Figure 8:
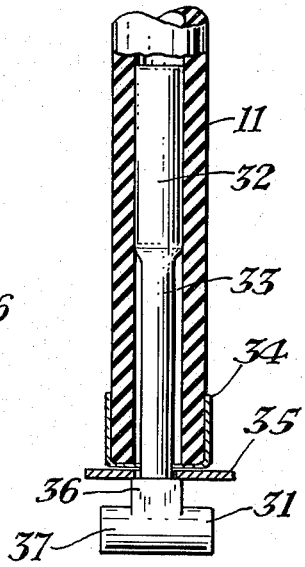
FIG. 8 is a sectional view of FIG. 6 showing the mandrel, neck, ferrule, washer and bayonet in assembled position.
Figure 9:
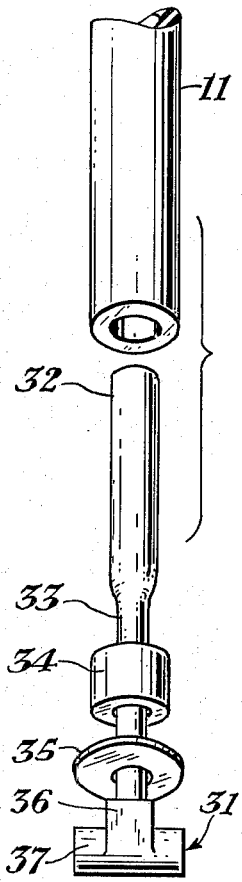
FIG. 9 is an exploded view of FIG. 6, showing the elements in position for assembly.

Distally, beyond the mandrel 32 is a neck 33 which terminates in the bayonet 31 which is provided with a parallelepipedal portion 36 and a cylindrical portion 37 (FIG. 8). The parallelepipedal portion is sized to pass through rectangular portion 43 of the bayonet openings 42 in the FIG. 12, and the cylindrical portion is sized to rest in the semi-cylindrical recesses 44 on the reverse side of the base 10. In assembly, the mandrel 32 is forced into the suspending line 11 to the point where the parallelepipedal portion 36 is spaced very slightly from the ferrule 34 and the washer 35. By this arrangement, the bayonet is firmly grasped by the suspending line to the point where it cannot be drawn therefrom by any normal load carried by the device.

Figure 11:
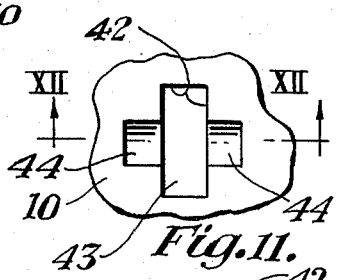
FIG. 11 is an enlarged view with the plate broken away of one of the bayonet openings from the reverse side.
Figure 12:
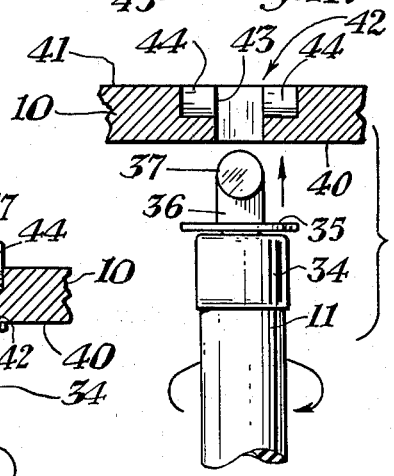
FIG. 12 is a sectional view of one of the bayonet openings taken along the line XII—XII of FIG. 11 with a side elevational view of the bayonet shown rotated 90° from normal, preliminary to being inserted in the bayonet opening in the direction of the arrow.
Figure 13:
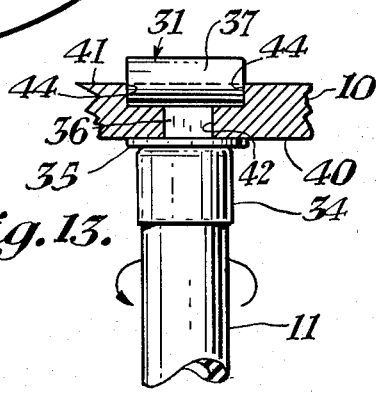
FIG. 13 is a sectional view of the bayonet opening, similar to FIG. 12, showing the bayonet in position after insertion and relaxation of the rotational force exerted to position it for insertion into the opening.

The method of inserting the bayonet 31 in the plate 10 is shown in FIGS. 11, 12 and 13. The line to be inserted is rotated 90° from its rest position as shown by the arrows in FIG. 12, and manual force is applied thereagainst at the proximal end of the mandrel 32 to the point where the bayonet projects from the ferrule 34 the width of the rectangular portion 43 of the bayonet opening 42 as it approaches the obverse 40 of the plate 10. The force is then relaxed and the flexible suspending line 11 and the bayonet 31 rotate to normal at a 90° turn as indicated by the arrow, FIG. 13, at which point of time the cylindrical portion 37 of the bayonet 31 comes tightly to rest in the semi-cylindrical recess 44 of the plate 10. To remove the bayonet, force is applied to the proximal end of the mandrel in a manner similar to that for insertion, the bayonet is then rotated 90° and withdrawn from the bayonet opening 42.

Figure 5:
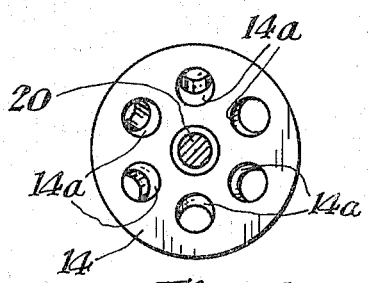
FIG. 5 is a view in the direction of the arrows V—V of FIG. 3 of the top of the disc associated with the braking means.
Figure 4:
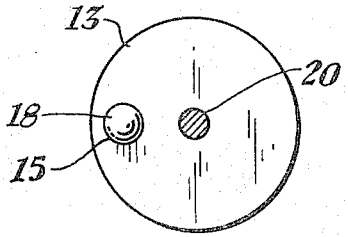
FIG. 4 is a view in the direction of the arrows IV—IV of FIG. 3 of the bottom of the base of the hanging means.
Figure 6:
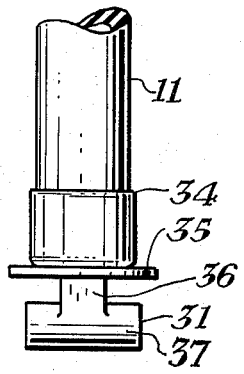
FIG. 6 is a side elevational view of the bayonet assembled to one of the flexible suspending lines, broken away.
Figure 7:
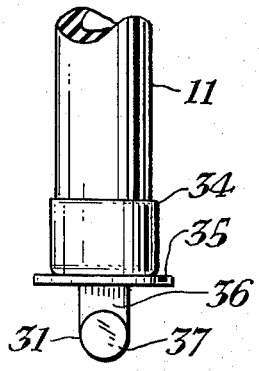
FIG. 7 is a view, similar to FIG. 6, but taken at an angle of 90° to the position of FIG. 7.

Referring now to the braking system shown in FIGS. 3, 4 and 5, the bottom base of base 13 of the rotatable hanging means 12 is provided with a single hemispherical recess 15 with a well **15*a* in which a spring 19 is located which selectively aligns with recesses 14*a* in rotatable disc 14. The spring 19 engages a ball 18 which rides in the hemispherical recess 15 of base 13 and one of the recesses 14*a* of disc 14. The hook portion 25 of the rotatable hanging means 12 terminates in an axle 20 upon which the rotatable disc 14 can turn, being held in position by the socket nut 21. As wire 28 is drawn from the carton 27, the rotatable disc 14 will turn in the direction in which the wire is drawn. The wire guide or fairlead 22 will turn with it. However, through the force of the spring 19 the ballbearing 18 engages the hemispherical portion 14*a* in the rotatable disc 14 sequentially, the tension of the spring being sufficient to cause the rotatable disc 14 to come to rest when the force of withdrawal is released. Thus a braking action is achieved which prevents further turning of the plate 10 after the wire withdrawal force is relaxed, the tension of the spring 19 acting on the ball 18** being set to accomplish this result.

Having fully described my invention, I claim:

1. In a fixture for unwinding coiled wire, including, as a part of the combination, rotatable hanging means, a plate and flexible suspending lines between the plate and rotatable hanging means, that improvement in the rotatable hanging means which comprises as elements a base;

an axle fixed to the base;

a rotatable disc mounted on said axle to which disc the suspending lines are attached;

a series of ball-receiving depressions on the inner face of said disc;

a single ball-receiving depression in the face of said base, the axis whereof is indexed with the axes of the depressions in the rotatable disc; and a spring-driven ball seated in the depression in said base, sequentially engaging said depressions in said disc as the disc is rotated.

2. In a fixture for unwinding coiled wire comprising rotatable hanging means, a plate and flexible suspending lines between the plate and rotatable hanging means, that improvement in the rotatable hanging means which includes a fixed element;

a second element rotatably supported on the fixed element;

a circular channel on the exterior of the fixed element, and a wire guide having a yoke rotatably supported in said circular channel, and an eye at its distal end through which the wire to be uncoiled may be threaded.

3. In a fixture for unwinding coiled wire comprising rotatable hanging means, a plate and flexible suspending lines between the plate and rotatable hanging means, the improvement wherein the plate has means for detachably connecting the flexible suspending lines thereto, said means including a rectangular opening in the plate having hemicylindrical recesses on either side of the rectangular opening on one side of said plate, the flexible suspending lines having a bayonet on the end thereof insertible through said opening from the side opposite said recesses;

said bayonet having cylindrical extensions extending outwardly therefrom for reception in said hemicylindrical recesses;

means external to said bayonet acting on said bayonet to retain it at right angles to said opening in a rest position, said bayonet being rotated against the force exerted by said means through an angle of 90° when said bayonet is being inserted through said opening, said bayonet returning to its normal position after insertion through said opening so that the cylindrical extensions thereof come to rest in said cylindrical recesses, said cylindrical extensions being held in a fixed position within said cylindrical recesses after insertion of the bayonet through said opening by force exerted by said means external to said bayonet.

4. In a fixture for unwinding coiled wire comprising rotatable hanging means, a plate and flexible suspending lines between the plate and rotatable hanging means, that improvement in the flexible suspending lines wherein said lines comprise a length of flexible tubing, a mandrel having a diameter larger than the relaxed inside diameter of said tubing insertable with force in one end of said tubing, a neck on said mandrel, smaller in diameter than the mandrel, a T-shaped cylindrical object at the distal end of said neck, and a ferrule to engage said tubing spaced from said cylindrical portion at the distal end of said neck when said mandrel and neck are inserted into said tubing and through an opening in said ferrule, the inner surface of said ferrule being of a size snugly to engage the end of said tubing, the neck of said mandrel being extendible by force supplied from behind said ferrule through the opening in said ferrule.

5. In a fixture for unwinding coiled wire comprising rotatable hanging means, a plate and flexible suspending lines between the plate and rotatable hanging means, the improvement wherein the rotatable hanging means includes a fixed element, a second element rotatably supported on the fixed element to which the flexible suspending lines are affixed, a circular channel on the exterior of the fixed element, a wire guide having a yoke rotatably supported in said circular saddle and an eye at the distal end through which the wire to be uncoiled may be threaded, the plate having means for detachably connecting the flexible suspending lines thereto.

6. The improvement claimed in claim 5 wherein the fixed element comprises a hook member having an axle fixed thereto and the second element comprises a disc rotatably mounted on said axle, said disc having a series of ball-receiving depressions on its inner face about said axle, the hook member having a base provided with a ball receiving depression in the face thereof, the axis whereof is indexed with the axes of the depressions on the inner face of the disc, and a spring driven ball seated in the depression in said disc as the disc is rotated.

7. The improvement claimed in claim 6 wherein the means for detachably connecting the flexible suspending lines to the plate include rectangular openings in the plate having hemi-cylindrical recesses on either side of said opening on one side of said plate and the suspending lines have a bayonet end insertable through said opening from the side opposite said recesses and include cylindrical extensions extending outwardly from the end of the bayonet to be received in said hemi-cylindrical recesses, means external to said bayonet acting on said bayonet to retain it at right angles to said opening in a rest position, the bayonet being rotated against the force exhibited by said means through an angle of 90° when said bayonet is being inserted through said opening, said bayonet returning to its normal position after insertion through said opening so that the cylindrical extensions thereon come to rest in said cylindrical recesses, and said cylindrical extension being held in a fixed position within said cylindrical recesses after insertion of the bayonet through said opening by force exhibited by said means external to said bayonet.

8. The improvement claimed in claim 7 wherein the flexible suspending lines each comprise a length of flexible tubing containing a mandrel having a diameter larger than the relaxed inside diameter of said tubing inserted with force in one end of said tubing, said mandrel having a neck smaller in diameter than the mandrel, the bayonet end being at the distal end of said neck, and a ferrule to engage said tubing spaced from the cylindrical extension of said bayonet at the distal end of said neck once said mandrel and neck are inserted into said tubing through an opening in said ferrule, the inner surface of said ferrule being of a size snugly to engage the end of said tubing, the neck of said mandrel being extendible by force supplied from behind said ferrule through the opening in said ferrule.

* * * * *

UNITED STATES PATENT OFFICE

CERTIFICATE OF CORRECTION

PATENT NO. : 3,974,980

DATED : August 17, 1976

INVENTOR(S) : William B. Marcell

It is certified that error appears in the above-identified patent and that said Letters Patent are hereby corrected as shown below:

Column 1, line 24, "or" changed to --of--;

Column 3, line 20, "Fig. 12" change to --plate 10 (Fig. 12)--

Signed and Sealed this

Twelfth Day of October 1976

[SEAL]

*Attest:*

RUTH C. MASON
*Attesting Officer*

C. MARSHALL DANN
*Commissioner of Patents and Trademarks*